US008272614B1

(12) United States Patent
Goodwin

(10) Patent No.: US 8,272,614 B1
(45) Date of Patent: Sep. 25, 2012

(54) BALANCING ARTICLE SUSPENSION DEVICE

(76) Inventor: Brian R. Goodwin, Fairfield, ME (US)

( * ) Notice: Subject to any disclaimer, the term of this patent is extended or adjusted under 35 U.S.C. 154(b) by 0 days.

(21) Appl. No.: 13/043,954

(22) Filed: Mar. 9, 2011

(51) Int. Cl.
*B42F 3/00* (2006.01)

(52) U.S. Cl. ..... 248/339; 248/914

(58) Field of Classification Search ..... 248/339, 248/304, 340, 908, 915, 914
See application file for complete search history.

(56) References Cited

U.S. PATENT DOCUMENTS

| | | | | |
|---|---|---|---|---|
| 2,190,800 | A | 2/1940 | Murphy | |
| 2,532,255 | A * | 11/1950 | Davis | 248/215 |
| 2,631,803 | A | 3/1953 | Meyers | |
| 2,692,108 | A | 10/1954 | Neivert | |
| 2,738,188 | A | 3/1956 | Hoffman | |
| 3,302,011 | A | 1/1967 | Katzei | |
| 3,880,280 | A | 4/1975 | Fyvolent | |
| 4,496,124 | A | 1/1985 | Cole | |
| 5,301,912 | A | 4/1994 | Chang | |
| D416,765 | S | 11/1999 | Dankwardt et al. | |
| 6,152,416 | A * | 11/2000 | Jacob | 248/441.1 |
| 6,530,548 | B2 * | 3/2003 | Pizzirusso | 248/304 |
| 6,682,032 | B1 | 1/2004 | Bradlee | |
| D546,168 | S | 7/2007 | Marvin | |
| 7,464,910 | B1 * | 12/2008 | St. Germain et al. | 248/301 |
| 2004/0108432 | A1 * | 6/2004 | Weitzman | 248/339 |
| 2005/0082454 | A1 * | 4/2005 | Adams | 248/304 |

* cited by examiner

*Primary Examiner* — Ramon Ramirez
(74) *Attorney, Agent, or Firm* — Verrill Dana, LLP; Chris A. Caseiro

(57) ABSTRACT

A device for supporting and suspending objects from a balance point on a surface. The device includes a balance contact, a retainer region, a display body, and a display surface. The display surface of the device may be configured into a design representing a particular figure or logo, or may simply be aesthetically pleasing. By using a balance contact on the surface without a counterbalance, the device provides a visually striking, unique way of holding objects.

7 Claims, 2 Drawing Sheets

BALANCING ARTICLE SUSPENSION DEVICE

BACKGROUND OF THE INVENTION

1. Field of the Invention

The present invention relates generally to suspension devices. More particularly, the present invention relates to a suspension device that balances on a single point and provides a useful and aesthetically interesting device from which to suspend various objects.

2. Description of the Prior Art

Devices configured to suspend objects from the edge of a ledge, table, or counter are known in the art. Generally such devices operate through a counterbalancing measure, as shown in U.S. Pat. No. 2,631,803. Counterbalancing devices known in the art employ a structural feature such as a supporting arm or brace that balances on the front face of the edge of the ledge or table the device is sitting on. These types of devices are suitable for use with a variety of objects such as handbags and purses, belts, or clothing. However, because of the structural feature of a supporting arm or brace, these devices are limited in terms of where they may be used successfully. For example, these counterbalancing devices would not be useable with many types of furniture, such as a thin-topped table with a single central leg, because the counterbalancing arm would not be able to reach a supporting face of the edge and the device would topple over. As such, there exists an ongoing need in the art for more versatile and aesthetically interesting suspension devices that function in new and different ways.

SUMMARY OF THE INVENTION

It is an object of the present invention to provide an improved suspension device for retaining items on the edge of a surface in a balanced manner. In one embodiment of the invention, the device includes a balance contact point and a display body. The display body may be configured to form a retainer region, and the display body may be configured to include a display surface at the front of the device. The display surface may be configured to include a design or image, such as a cartoon, team logo, or school mascot character. These are merely representative examples, and the invention is not limited thereto.

In one embodiment, the device is formed from a single element. In other embodiments, the device may be formed from more than one interlocking or interconnecting pieces or elements designed to fit together and, when assembled, the multipart device includes a balance contact point, a retainer region, and a display body with a display surface, which may be located at the front of the device but is not limited thereto.

The back of the main display body includes a lower end formed into a retainer region of selectable arc or angle (first angle). The retainer region extends to a balance structure roughly in the shape of a tail with a curve of selectable angle (second angle) Formed between the balance structure and the lower end of the display body. The tail terminates in a balance structure with a balance contact having a selectable radius of curvature. The balance contact is intended to be placed on an underlying support structure, such as a dresser, table, or counter, but is not limited thereto. The balance contact point is the only portion of the device in contact with the supporting surface from which the device hangs. In one embodiment, the balance contact point is a single area contact point. In other embodiments, the balance contact point may include two or more prongs, such that the balance contact point has the appearance of an inverted Y. The one or more balance contact points form/forms the second angle with the lower end of the display body.

The user may place the device on the structure by putting the balance contact on the structure at or near its edge so that the main display body is spaced from or hangs off the structure. The user may then place an item to be retained, such as a belt, handbag, necklace, bracelet, hat, etc., in the retainer region so that it loops around the main display body. The user can then release both the item and the device and the device will remain balanced on the surface with the item extending spaced from the edge of the structure. Suspending objects in this fashion conserves counter and table space for other uses.

The dimensions of the main display body, the retainer region, the angle and the balance contact are selectable and dependent on the weight of the item to be retained. The result is a clever and functional way to retain something and the device can be used on any surface, regardless of the specific design of its edge. In other words, the balance contact of the present invention is configured to contact the underlying surface independent of the edge of that surface. The device is formed from any suitable material known in the art that is functional and aesthetically pleasing, and may include metal, wood, glass, clay or plastic, although the invention is not limited thereto.

These and other objects of the present invention will be more fully understood upon review of the following detailed description, the accompanying drawings, and the appended claims.

DETAILED DESCRIPTION OF THE PREFERRED EMBODIMENTS OF THE INVENTION

Figure 1:
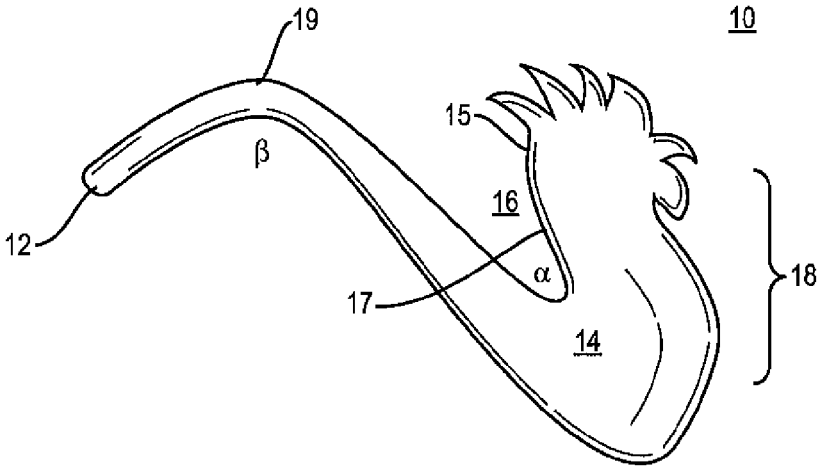
FIG. 1 is a side view of one embodiment of the suspension device.

A representative embodiment of a balancing suspension device 10 of the present invention is shown in FIG. 1. The balancing suspension device 10 includes a balance contact 12 formed from the display body 14. The display body 14 is configured to have a retainer region 16 suitable for holding various articles and a display surface 18. In the embodiment of the device 10 shown in FIG. 1 the display surface 18 is in the form of a stylized rooster, although this is merely for illustrative purposes and by no means limits the scope of the claimed invention.

As seen in FIG. 1, a back 15 of the display body 14 includes a lower end 17 formed into the retainer region 16. The retainer region 16 is of selectable arc or angle $\alpha$, and extends roughly in the shape of a tail 19 with a curve of selectable angle $\beta$. The tail 19 terminates in the balance contact 12. The balance contact 12 has a selectable radius of curvature. The dimensions of the main display body 14, the retainer region 16, the angles $\alpha$ and $\beta$, and the balance contact 12 are selectable and dependent on the weight of the item or items to be retained and are configured such that the center of gravity of the device 10 and the object or objects to be held combined can be supported by the balance contact 12 without any counterbalance or other support being required.

The display surface 18 of the display body 14 may be configured into various shapes or designs. For example, the device 10 may be configured to represent the logo or mascot of a school or sports team or a cartoon character or the like. Alternatively, the display surface 18 may be configured into an aesthetically pleasing shape or design.

Figure 2:
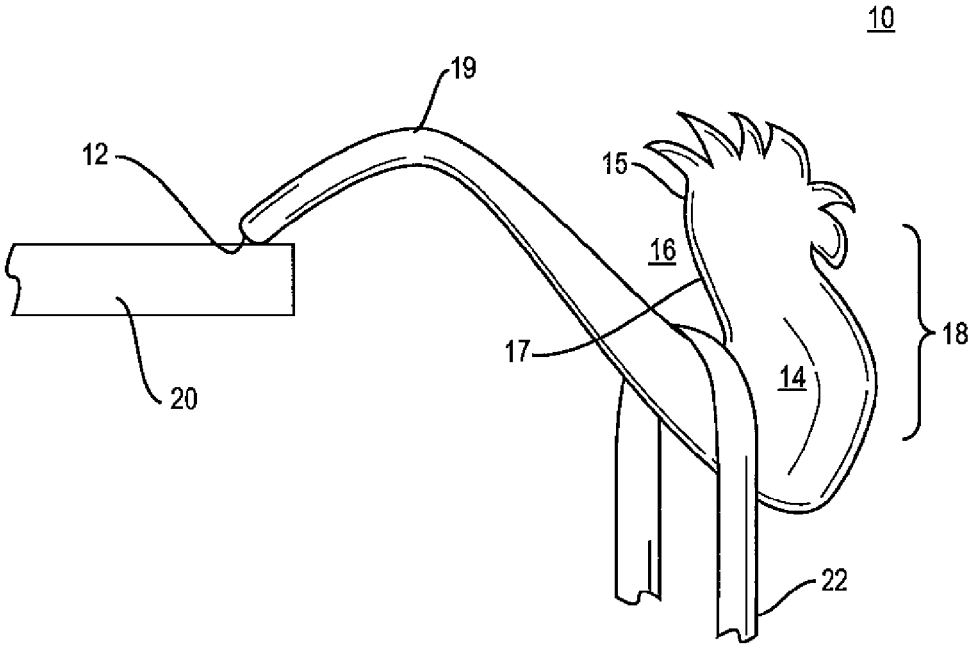
FIG. 2 is a side view of the suspension device of FIG. 1 in use.

The device 10 is shown in use in FIG. 2. As can be seen, the balance contact 12 is in contact with a surface 20. The support surface 20 may be the surface of a table, counter, or any other suitable piece of furniture or object having a surface from which it is desired to support an object. An object 22 is shown supported in place at the retainer region 16 of the device 10. Any suitable object 22 may be used with the device 10 of the present invention. Representative objects include belts, purses, handbags, hair bands, necklaces, anklets, and bracelets, although the present invention is not limited thereto.

Figure 3:
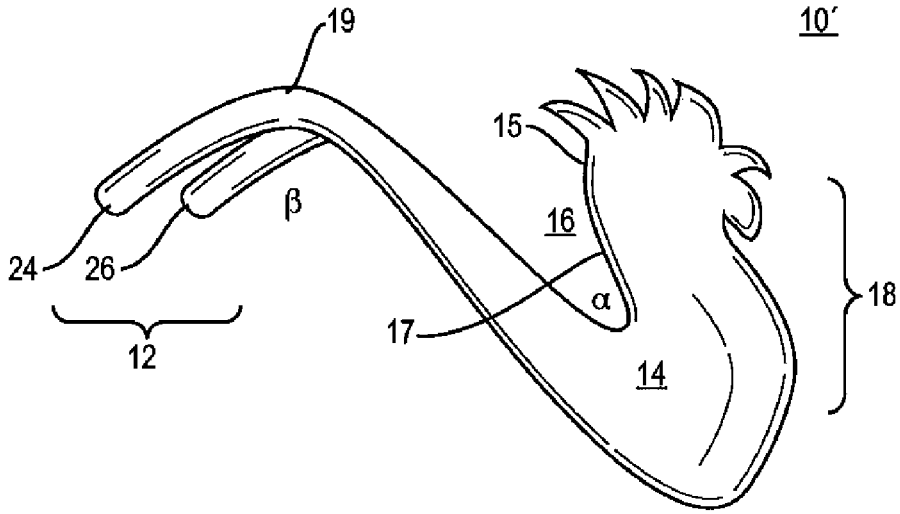
FIG. 3 is a side view of a second embodiment of the suspension device illustrating a two-pronged balance contact point.
Figure 4:
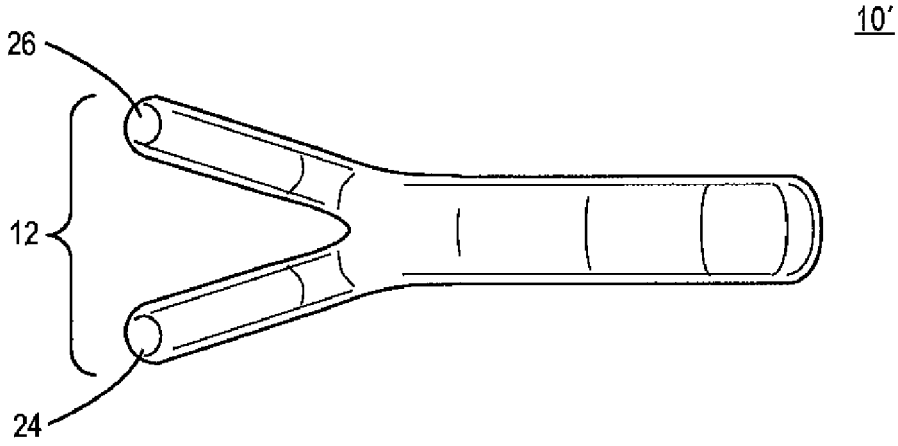
FIG. 4 is a bottom view of the second embodiment of the suspension device of FIG. 3.

The embodiment shown in FIGS. 1 and 2 has a single contact point, but it is to be understood that the device can be configured so that the balance contact 12 was in contact with the surface 20 at two or more contact points. FIG. 3 shows a balancing suspension device 10' with a two-pronged balance contact 12 with contact points 24, 26. The contact points 24, 26 together make up the balance contact 12. FIG. 4 illustrates the balance contact 12, contact points 24, 26 and back 15' of the device 10'. Multiple contact points may be useful in increasing the stability of the device 10 or in more appropriately representing a particular image or character on the display surface 18 of the device 10. As an illustrative example, a fish design may be best represented with a two-pronged balance contact 12 in order to provide a more accurate stylistic representation of a fish tail. Furthermore, multiple contact points in the balance contact 12 may allow the display body 14 to be larger and remain balanced, and therefore more of a display surface 18 may be available for decorative purposes.

The present invention has been described with respect to various examples. Nevertheless, it is to be understood that various modifications may be made without departing from the spirit and scope of the invention. All equivalents are deemed to fall within the scope of this description of the invention.

What is claimed is:

1. A balancing suspension device to retain an object comprising:

one or more balance contacts each having a radius of curvature configured to be in contact with an underlying support surface having an edge, wherein the one or more balance contacts balance the device on the support surface without any part of the suspension device contacting the edge of the support surface; and a display body with a back where the balance contact is located and a lower end;

wherein the display body is configured to create a retainer region in the lower end of the display body from which an object can be suspended.

2. The balancing suspension device of claim 1, wherein the display body is configured to create the retainer region by forming a first angle.

3. The balancing suspension device of claim 2, wherein the display body is configured to create the one or more balance contacts by forming a second angle between the one or more balance contacts and the lower end of the display body.

4. The balancing suspension device of claim 1, wherein the device is formed of a single element.

5. The balancing suspension device of claim 1, wherein the device is formed of more than one element, wherein the elements are designed to fit together.

6. The balancing suspension device of claim 1, wherein the display body is configured to include a display surface representing a design or image.

7. The balancing suspension device of claim 1, wherein the device is made from a material selected from the group consisting of wood, plastic, glass, clay, and metal.

* * * * *